US011933294B2

(12) United States Patent
Masuda

(10) Patent No.: US 11,933,294 B2
(45) Date of Patent: Mar. 19, 2024

(54) PUMP SYSTEM

(71) Applicant: IHI Corporation, Koto-ku (JP)

(72) Inventor: Seiei Masuda, Tokyo (JP)

(73) Assignee: IHI Corporation, Koto-ku (JP)

( * ) Notice: Subject to any disclaimer, the term of this patent is extended or adjusted under 35 U.S.C. 154(b) by 288 days.

(21) Appl. No.: 17/617,197

(22) PCT Filed: Jun. 4, 2020

(86) PCT No.: PCT/JP2020/022101
§ 371 (c)(1),
(2) Date: Dec. 7, 2021

(87) PCT Pub. No.: WO2020/250796
PCT Pub. Date: Dec. 17, 2020

(65) Prior Publication Data

US 2022/0235767 A1 Jul. 28, 2022

(30) Foreign Application Priority Data

Jun. 11, 2019 (JP) ..... 2019-108643

(51) Int. Cl.
*F04C 14/02* (2006.01)
*F04C 14/26* (2006.01)
*F04C 15/06* (2006.01)

(52) U.S. Cl.
CPC ..... *F04C 14/02* (2013.01); *F04C 14/26* (2013.01); *F04C 15/06* (2013.01); *F04C 2240/30* (2013.01)

(58) Field of Classification Search
CPC ..... F04C 2/10; F04C 2/12; F04C 2/14; F04C 2/18; F04C 11/00; F04C 11/001;
(Continued)

(56) References Cited

U.S. PATENT DOCUMENTS

2010/0054963 A1 3/2010 Yokoi et al.
2011/0289925 A1 12/2011 Dyer et al.
2015/0285150 A1 10/2015 Masuda

FOREIGN PATENT DOCUMENTS

EP 2 947 297 A1 11/2015
EP 3 324 048 A1 5/2018
(Continued)

OTHER PUBLICATIONS

International Search Report dated Jul. 7, 2020 in PCT/JP2020/022101 filed on Jun. 4, 2020, 2 pages.

*Primary Examiner* — Kenneth J Hansen
*Assistant Examiner* — Chirag Jariwala
(74) *Attorney, Agent, or Firm* — Oblon, McClelland, Maier & Neustadt, L.L.P.

(57) ABSTRACT

A pump system includes a triple-gear pump which pressurizes a fluid using three gears; an outlet flow path which guides the fluid from a first pressure-increasing portion to an outlet; a first flow path which guides the fluid from the first pressure-increasing portion to a second pressure-increasing portion; a second flow path which guides the fluid from the second pressure-increasing portion to the outlet flow path; a third flow path connected to the first flow path and the second flow path; a first valve device provided in the first flow path; a second valve device provided in the second flow path, and a control device which controls the first valve device. When the first pressure-increasing portion and the second pressure-increasing portion are switched from a parallel state to a series state, the control device causes the first valve device to open after the second valve device is closed.

8 Claims, 2 Drawing Sheets

(58) Field of Classification Search
CPC ..... F04C 14/02; F04C 14/24; F04C 14/26; F04C 15/06; F02C 7/236
USPC ..... 418/10; 417/62, 410.3, 410.4
See application file for complete search history.

(56) References Cited

FOREIGN PATENT DOCUMENTS

| | | | | | |
|---|---|---|---|---|---|
| JP | 2002-303160 | A | | 10/2002 | |
| JP | 2003328958 | A | * | 11/2003 | ..... F04C 11/00 |
| JP | 2004197573 | A | * | 7/2004 | ..... F04C 11/00 |
| JP | 2010-53693 | A | | 3/2010 | |
| JP | 2012-193693 | A | | 10/2012 | |
| JP | 5087696 | B2 | | 12/2012 | |
| JP | 2014-137053 | A | | 7/2014 | |

* cited by examiner

PUMP SYSTEM

The present application is a U.S. National Stage Entry of PCT/JP2020/022101, filed Jun. 4, 2020. Priority is claimed to Japanese Patent Application No. 2019-108643, filed Jun. 11, 2019, the content of which is incorporated herein by reference.

TECHNICAL FIELD

The present disclosure relates to a pump system.

BACKGROUND

For example, Patent Literature 1 discloses a fuel system which pressurizes and supplies fuel. In this fuel system, fuel is pressurized using a triple-gear pump. In the triple-gear pump, two pressure-increasing portions are formed on three gears and it is possible to switch between a state in which the two pressure-increasing portions are connected in series through flow paths and a state in which the two pressure-increasing portions are connected in parallel through flow paths. In the triple-gear pump, the two pressure-increasing portions are connected in parallel when a discharge flow rate is desired to be increased and the two pressure-increasing portions are connected in series when a discharge flow rate is desired to be decreased.

DOCUMENT OF RELATED ART

Patent Document

[Patent Document 1] Japanese Unexamined Patent Application, First Publication No. 2014-137053

SUMMARY

Technical Problem

However, in Patent Literature 1 described above, the switching between the parallel state and the series state of the pressure-increasing portions is performed only by opening and closing one variable throttle valve. For this reason, on an outlet side, when the parallel state is switched to the series state, a flow rate of fuel rapidly and significantly changes to about half, causing pressure pulsation. If the variable throttle valve is operated gently in order to improve this problem, a switching operation takes a long time.

The present disclosure is made in view of the above problems, and an object of the present disclosure is to minimize pressure pulsation (fluid pressure pulsation) on an outlet side when switching between a series state and a parallel state is performed in a pump system.

Solution to Problem

A pump system of a first aspect of the present disclosure for solving the above problems includes a triple-gear pump which pressurizes a fluid using three gears; an outlet flow path which guides the fluid from a first pressure-increasing portion to an outlet; a first flow path which guides the fluid from the first pressure-increasing portion to a second pressure-increasing portion; a second flow path which guides the fluid from the second pressure-increasing portion to the outlet flow path; a third flow path connected to the first flow path and the second flow path; a first valve device provided in the first flow path; a second valve device provided in the second flow path; and a control device which controls the first valve device, wherein, when the first pressure-increasing portion and the second pressure-increasing portion are switched from a parallel state to a series state, the control device causes the first valve device to open after the second valve device is closed.

A second aspect of the present disclosure is that in the pump system of the first aspect, the second valve device is a check valve which blocks an inflow of the fluid from the outlet flow path toward the second pressure-increasing portion.

A third aspect of the present disclosure is that the pump system of the first or second aspect includes: a third valve device provided in the third flow path and controlled by the control device, wherein, when the first pressure-increasing portion and the second pressure-increasing portion are switched from the parallel state to the series state, the control device causes the third valve device to open before the first valve device is opened.

A fourth aspect of the present disclosure is that the pump system of the first to third aspects includes: a fluid supply flow path connected to the first pressure-increasing portion and the third flow path and configured to supply the fluid from outside; and a check valve provided in the fluid supply flow path.

Effects

According to the present disclosure, a first valve device is closed after a second valve device is closed. For this reason, after a flow of each flow path has been changed, a fluid flows from a first pressure-increasing portion into a second pressure-increasing portion and changes in flow rate and pressure in an outlet flow path become gradual.

Therefore, it is possible to minimize pressure pulsation on an outlet side.

DESCRIPTION OF EMBODIMENTS

An embodiment of a pump system according to the present disclosure will be described below with reference to the drawings.

Figure 1:
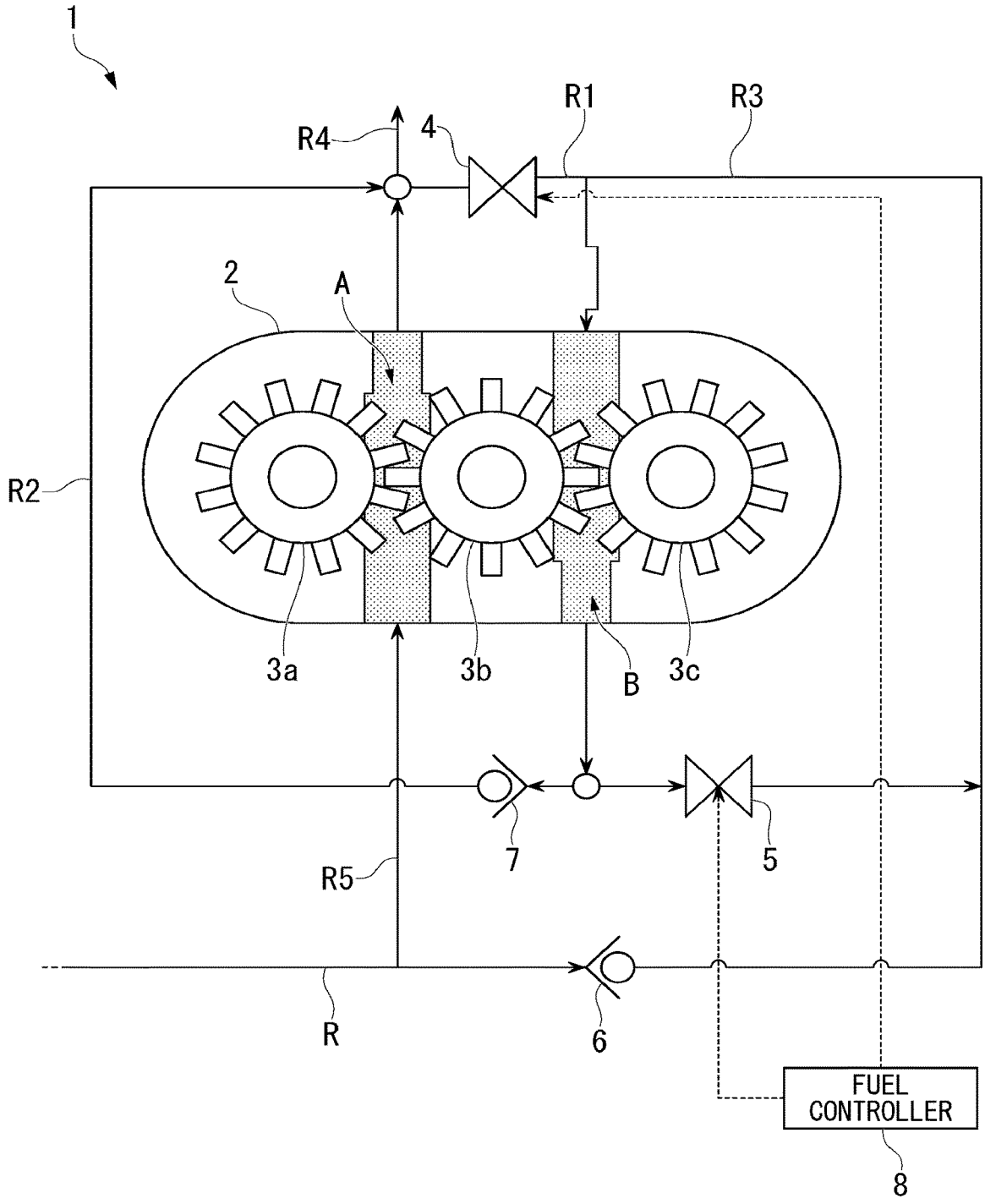
FIG. 1 is a schematic diagram illustrating a pump system according to an embodiment of the present disclosure.

As illustrated in FIG. 1, a pump system 1 according to the embodiment is, for example, a device which pressurizes liquid fuel (a fluid) and includes a casing 2, three gears 3*a*, 3*b*, and 3*c*, a first throttle valve 4 (a first valve device), a second throttle valve 5 (a third valve device), a first check valve 6, a second check valve 7 (a second valve device), a fuel controller 8 (a control device), a supply flow path R, a first flow path R1, a second flow path R2, a third flow path R3, and an outlet flow path R4. The supply flow path R guides fuel to an inlet of a first pressure-increasing portion A and the third flow path R3. In such a pump system 1, liquid fuel guided from outside through the supply flow path R is pressurized and discharged through the outlet flow path R4.

The casing 2 is a container having the three gears 3*a*, 3*b*, and 3*c* accommodated therein. In the casing 2, a volume chamber in which liquid fuel is pressurized is formed in a first pressure-increasing portion A and a second pressure-increasing portion B which will be described later.

The gears 3*a*, 3*b*, and 3*c* mesh with each other and are rotated due to a power (not shown) which operates based on an instruction of the fuel controller 8. The power may be derived, for example, from an output shaft of an electric motor, a turbine connected to the pump system 1, or the like. The gear 3*b* meshes with the gear 3*a* and the gear 3*c*. That is to say, the triple-gear pump is constituted by the first pressure-increasing portion A in the present disclosure using the gear 3*a* and the gear 3*b* and the second pressure-increasing portion B in the present disclosure using the gear 3*b* and the gear 3*c*. Such a first pressure-increasing portion A is connected to a branch flow path R5 which branches from the supply flow path R and is connected to the outlet flow path R4 on the outlet side of the first pressure-increasing portion A. Moreover, the second pressure-increasing portion B is connected to the first flow path R1 on the inlet side of the second pressure-increasing portion B and is connected to the second flow path R2 on the outlet side of the second pressure-increasing portion B.

Also, the first flow path R1 is connected to the outlet flow path R4. Furthermore, a downstream end portion of the second flow path R2 is connected to the outlet flow path R4. In addition, the third flow path R3 is connected to the supply flow path R, the first flow path R1, and an upstream of the second flow path R2. That is to say, the first pressure-increasing portion A and the second pressure-increasing portion B are connected in series through the first flow path R1 and the second flow path R2. Moreover, the first pressure-increasing portion A and the second pressure-increasing portion B are connected in parallel through the first flow path R1 and the third flow path R3.

The first throttle valve 4 is provided in the first flow path R1 and thereby it is possible to change a flow rate of liquid fuel flowing from the first pressure-increasing portion A to the second pressure-increasing portion B.

The second throttle valve 5 is provided in the vicinity of an end in the third flow path R3 on a side connected to the second flow path R2 and thereby it is possible to change an amount of liquid fuel discharged from the second pressure-increasing portion B and flowing into the third flow path R3. Furthermore, the first throttle valve 4 and the second throttle valve 5 are electric valves and are controlled by the fuel controller 8.

The first check valve 6 is provided in the supply flow path R, is driven due to a differential pressure between liquid fuel upstream of the first check valve 6 and the liquid fuel downstream of the first check valve 6 (the liquid fuel in the third flow path R3) in the supply flow path R, and blocks the inflow of the liquid fuel from the third flow path R3 to the supply flow path R.

The second check valve 7 is provided in the second flow path R2, is driven due to a differential pressure between the liquid fuel upstream of the second check valve 7 and the liquid fuel downstream of the second check valve 7 (the liquid fuel in the outlet flow path R4 side) in the second flow path R2, and blocks the inflow of the liquid fuel from the outlet flow path R4 toward the second pressure-increasing portion B.

The fuel controller 8 may include a central processing unit (CPU), a memory such as a random-access memory (RAM) and a read-only memory (ROM), a storage device such as a hard disk drive (HDD) and a solid-state drive (SSD), and an input/output device.

In such a pump system 1, when the first pressure-increasing portion A and the second pressure-increasing portion B are connected in a parallel state, the first throttle valve 4 and the second throttle valve 5 are closed. In the parallel state, fuel which has passed through the supply flow path R is guided to the first pressure-increasing portion A and the third flow path R3. Fuel which has passed through the third flow path R3 is supplied to the second pressure-increasing portion B. Thus, the liquid fuel which has passed through the supply flow path R is directly supplied to the first pressure-increasing portion A and the second pressure-increasing portion B. Furthermore, the liquid fuel pressurized in the first pressure-increasing portion A is guided to the outlet flow path R4. In addition, the liquid fuel pressurized in the second pressure-increasing portion B is guided to the outlet flow path R4 via the second flow path R2.

Figure 2:
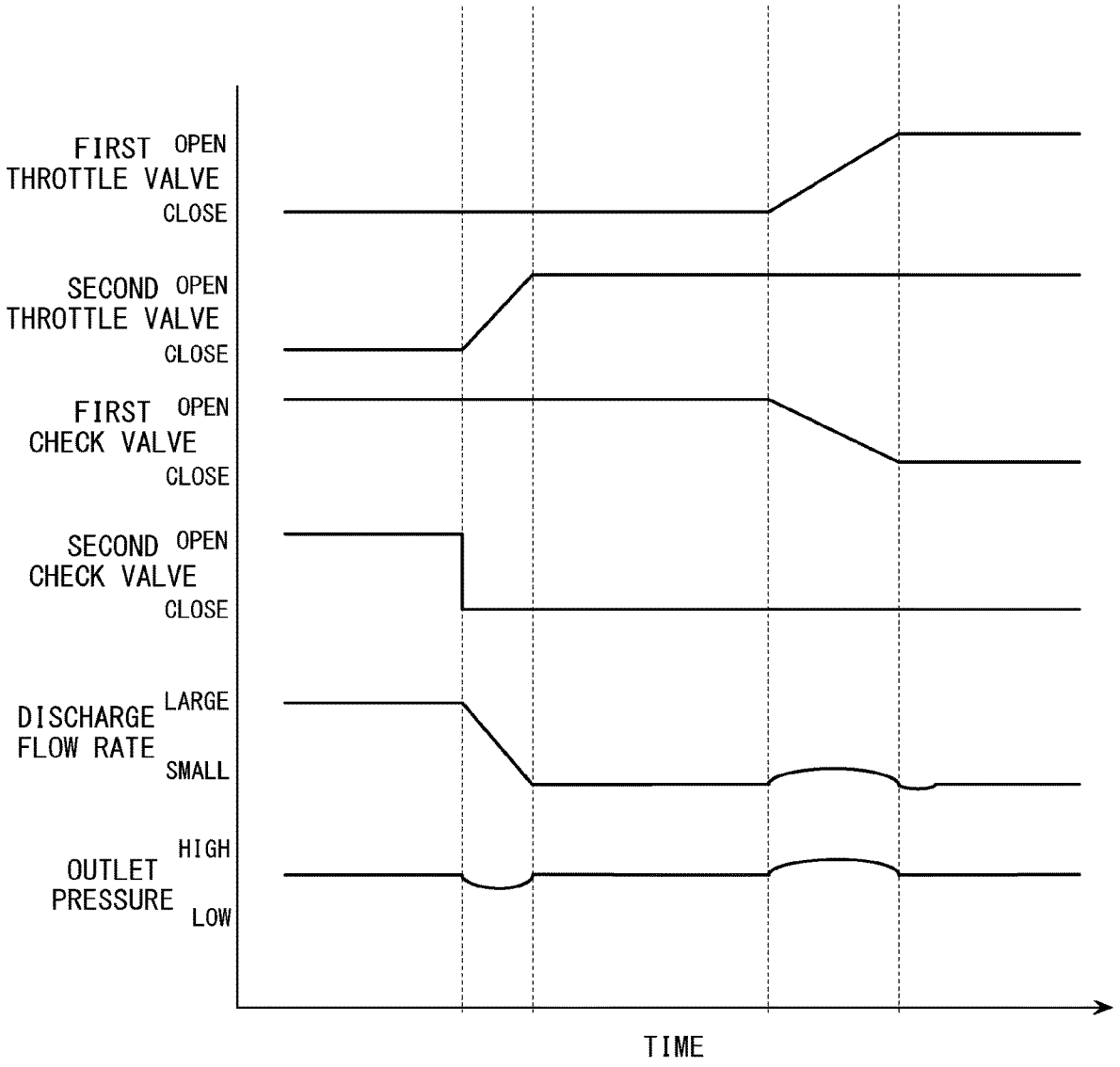
FIG. 2 is a time chart describing a degree of valve opening, a discharge flow rate, and an outlet pressure of the pump system according to the embodiment of the present disclosure.

As illustrated in FIG. 2, when the first pressure-increasing portion A and the second pressure-increasing portion B change to a series state (are switched from a parallel state to a series state), first, the second throttle valve 5 is gradually opened by the fuel controller 8 and the liquid fuel in the second flow path R2 is pressurized accordingly. Thus, the second check valve 7 is closed. Therefore, the liquid fuel discharged from the second pressure-increasing portion B gradually flows into the third flow path R3. At this time, since the flow rate in which the liquid fuel flows into the second pressure-increasing portion B is larger than the flow rate in which the liquid fuel is discharged from the second pressure-increasing portion B, the liquid fuel is not pressurized in the flow paths upstream of the second pressure-increasing portion B (the first flow path R1 and the third flow path R3). The second throttle valve 5 is gradually opened over about 1 second. Through such an operation, the discharge flow rate of the pump system 1 is halved. Furthermore, the pressure on the outlet side (an outlet pressure and the pressure of the liquid fuel in the outlet flow path R4) slightly decreases due to pulsation and then returns to the original pressure.

Also, when the fuel controller 8 causes the first throttle valve 4 to gradually open, the liquid fuel discharged from the first pressure-increasing portion A flows into the first flow path R1. Thus, the flow rate flowing into the second pressure-increasing portion B gradually increases and the liquid fuel of the flow paths upstream of the second pressure-increasing portion B (the first flow path R1 and the third flow path R3) is pressurized. Therefore, in the supply flow path R connected to the third flow path R3, the pressure of the liquid fuel downstream of the first check valve 6 becomes larger than the pressure of the liquid fuel upstream of the first check valve 6. Thus, the first check valve 6 is closed. As a result, the inflow of the liquid fuel into the second pressure-increasing portion B via the third flow path R3 stops. Through such an operation, the discharge flow rate of the pump system 1 is slightly increased due to pulsation when the first throttle valve 4 is opened and returns to the original discharge flow rate. Similarly, the outlet pressure also increases slightly and returns to the original pressure.

If the first throttle valve 4 is fully opened, the pressure of the liquid fuel in the third flow path R3 becomes equal to the pressure of the liquid fuel in the first flow path R1. Thus, the inflow of the liquid fuel from the first flow path R1 to the third flow path R3 stops. Therefore, the first pressure-increasing portion A and the second pressure-increasing portion B change to a series state. That is to say, the liquid fuel discharged from the first pressure-increasing portion A passes through the first flow path R1 and flows into the second pressure-increasing portion B and is discharged through the outlet flow path R4. As a result, the pump system 1 is changed from a parallel state to a series state. At this time, since the liquid fuel has the same flow rate upstream and downstream of the second pressure-increasing portion B, the pressure of the liquid fuel does not increase in the second pressure-increasing portion B.

Such a series of switching operations is performed in about 2 seconds. Furthermore, when the switching from a series state to a parallel state is performed, the pump system 1 operates each valve in the reverse order of the above.

According to the embodiment, when the pump system 1 is changed from the parallel state to the series state, it is possible to gently pressurize the liquid fuel flowing into the second pressure-increasing portion B by gradually opening the first throttle valve 4 after all the other valve operations. Therefore, it is possible to perform the switching to the series state in a short time and it is possible to minimize sudden pressure pulsation in the outlet flow path R4. It is also possible to make the pressure pulsation smaller by sufficiently lengthening a valve opening time of the second throttle valve 5 and the first throttle valve 4.

Also, according to the embodiment, the pump system 1 includes the second check valve 7 as a second valve device. Thus, it is possible to drive the second valve device due to the differential pressure (the differential pressure between upstream and downstream of the second valve device) without an operation using the control device. Therefore, the control by the fuel controller 8 is simple and easy.

Furthermore, according to the embodiment, the pump system 1 opens the first throttle valve 4 after the second throttle valve 5 is closed. Thus, the liquid fuel in the third flow path R3 is gently pressurized with the opening of the first throttle valve 4. Therefore, it is possible to perform the switching to the series state in a short time and it is possible to minimize sudden pressure pulsation in the outlet flow path R4.

Similarly, also when the switching from a series state to a parallel state is performed, it is possible to minimize pressure pulsation in the outlet flow path R4 when the switching from the series state to the parallel state is performed by closing the second throttle valve 5 after the first throttle valve 4 is closed.

Although the preferred embodiments of the present disclosure have been described above with reference to the drawings, the present disclosure is not limited to the above embodiments. The various shapes and combinations of the constituent members shown in the above embodiments are examples and can be variously changed within the scope of the present disclosure based on design requirements and the like.

Although a device including the second check valve 7 is described in the above embodiments, the present disclosure is not limited thereto. Instead of the second check valve 7, a throttle valve may be provided at the same position as the second check valve 7. In this case, the throttle valve is closed by the fuel controller 8 when the switching from a parallel state to a series state is performed.

Also, although the pump system 1 is a device which pressurizes liquid fuel as a fluid in the above embodiments, the present disclosure is not limited thereto. The pump system 1 may be a device which pressurizes other liquids.

INDUSTRIAL APPLICABILITY

The present disclosure can be applied to a pump system including a triple-gear pump which pressurizes a fluid using three gears.

The invention claimed is:

1. A pump system comprising:

a triple-gear pump which pressurizes a fluid using three gears;

an outlet flow path which guides the fluid from a first pressure-increasing portion to an outlet;

a first flow path which guides the fluid from the first pressure-increasing portion to a second pressure-increasing portion;

a second flow path which guides the fluid from the second pressure-increasing portion to the outlet flow path;

a third flow path connected to the first flow path and the second flow path;

a first valve device provided in the first flow path;

a second valve device provided in the second flow path; and a control device which controls the first valve device, wherein the control device is configured to cause the first valve device to open after the second valve device is closed when the first pressure-increasing portion and the second pressure-increasing portion are switched from a parallel state to a series state.

2. The pump system according to claim 1, comprising:

a fluid supply flow path connected to the first pressure-increasing portion and the third flow path and configured to supply the fluid from outside; and a check valve provided in the fluid supply flow path.

3. The pump system according to claim 1, comprising:

a third valve device provided in the third flow path and controlled by the control device, wherein, when the first pressure-increasing portion and the second pressure-increasing portion are switched from the parallel state to the series state, the control device causes the third valve device to open before the first valve device is opened.

4. The pump system according to claim 3, comprising:

a fluid supply flow path connected to the first pressure-increasing portion and the third flow path and configured to supply the fluid from outside; and a check valve provided in the fluid supply flow path.

5. The pump system according to claim 1, wherein the second valve device is a check valve which blocks an inflow of the fluid from the outlet flow path toward the second pressure-increasing portion.

6. The pump system according to claim 5, comprising:

a fluid supply flow path connected to the first pressure-increasing portion and the third flow path and configured to supply the fluid from outside; and a check valve provided in the fluid supply flow path.

7. The pump system according to claim 5, comprising:

a third valve device provided in the third flow path and controlled by the control device, wherein, when the first pressure-increasing portion and the second pressure-increasing portion are switched from the parallel state to the series state, the control device causes the third valve device to open before the first valve device is opened.

8. The pump system according to claim 7, comprising:

a fluid supply flow path connected to the first pressure-increasing portion and the third flow path and configured to supply the fluid from outside; and a check valve provided in the fluid supply flow path.

* * * * *